US005112710A

United States Patent [19]

Shimura et al.

[11] Patent Number: 5,112,710

[45] Date of Patent: May 12, 1992

[54] ELECTROPHOTOGRAPHIC IMAGE FORMING METHOD

[75] Inventors: Hidetsugu Shimura, Nagano; Hiroshi Ito, Nagano, both of Japan

[73] Assignee: Seiko Epson Corporation, Tokyo, Japan

[21] Appl. No.: 646,047

[22] Filed: Jan. 28, 1991

Related U.S. Application Data

[62] Division of Ser. No. 247,003, Sep. 20, 1988, Pat. No. 5,002,845.

[30] Foreign Application Priority Data

Sep. 21, 1987 [JP] Japan ..... 62-236466

[51] Int. Cl.[5] ..... G03G 13/01; G03G 13/22

[52] U.S. Cl. ..... 430/46; 430/42; 430/31; 430/55

[58] Field of Search ..... 430/31, 55, 42, 46

[56] References Cited

U.S. PATENT DOCUMENTS

| | | | |
|---|---|---|---|
| 4,197,119 | 4/1980 | Sadamatsu et al. | 430/55 |
| 4,390,609 | 6/1983 | Wiedemann | 430/58 |
| 4,444,859 | 4/1984 | Mimura | 430/55 X |
| 4,457,993 | 7/1984 | Nishikawa | 430/55 X |
| 4,489,148 | 12/1984 | Horgan | 430/59 |
| 4,515,462 | 5/1985 | Yoreda | 430/42 X |

FOREIGN PATENT DOCUMENTS 13250 1/1986 Japan .

96662 4/1988 Japan .

OTHER PUBLICATIONS

Griffiths et al., "Ambipolar Photoresponsive Devices", *Xerox Disclosure Journal*, vol. 7, No. 6, Nov. Dec. 1982.

Mitsui, "Canography in Electrophotography", IEEE Transactions, vol. Ed.—19, No. 4, Apr. 1972, pp. 396–404.

Makamura, "Electrophotographic Processes . . . ", IEEE Transactions, vol. Ed.—19, No. 4, Apr. 1972, pp. 405–412.

*Primary Examiner*—Roland Martin

*Attorney, Agent, or Firm*—Blum Kaplan

[57] ABSTRACT

An electrophotographic image forming member for forming color images including an organic photosensitive layer sandwiched between a dielectric layer and a conductive layer. The photoconductive layer includes a first charge generation layer adjacent to the conductive layer, a charge transfer layer on the first charge generation layer and a second charge generation layer on the charge transfer layer. During exposure, resistance of the photosensitive layer is reduced so that charges can flow through the photosensitive layer to create oppositely charged portions of the image forming member corresponding to a desired image of each color. Appropriately charged color toner adheres to the surface of the image forming member in the form of the desired image. After each color toner image is formed, the completed color image is transferred to a transfer medium.

15 Claims, 4 Drawing Sheets

ELECTROPHOTOGRAPHIC IMAGE FORMING METHOD

This is a division of application Ser. No. 07/247,003, filed Sep. 20, 1988, U.S. Pat. No. 5,002,845.

BACKGROUND OF THE INVENTION

The invention relates generally to an electrophotographic image forming member and a method and apparatus for forming color images utilizing the image forming member.

Conventional methods of forming electrophotographic images by selectively applying toner to a transfer drum suffer from several drawbacks. These devices utilize poisonous materials and the transfer methods require large, complicated and expensive equipment.

In, IEEE Transactions On Electron Devices, Vol. Ed.—19, No. 4, pp. 396–412 (Apr. 1972), examples of conventional electrophotographic image forming devices are discussed. These devices include inorganic photosensitive material sandwiched between a base and a dielectric layer. This description concerns a method of forming a single color image which includes the use of inorganic photosensitive materials, such as CdS and α-Se which are toxic materials.

A conventional "transfer drum method" utilizes a single transfer drum to transfer a toner image from the transfer drum to a transfer medium. In this method it is necessary to develop the toner image many times to obtain one color image. The life of the image forming material employed is shorter than the image forming material used for an ordinary monochromatic process. Additionally, positioning the toner with respect to the transfer medium requires very high accuracy and therefore the associated mechanisms are unavoidably complicated.

In another conventional electrophotographic process known as the "lump transfer method", multiple sets of exposing machines and developing machines and repeated developments are required.

Accordingly, it is desireable to develop an improved electrophotographic image forming member and method and an apparatus for practicing the method which avoids the shortcomings of the prior art.

SUMMARY OF THE INVENTION

Generally speaking, in accordance with the invention, an electrophotographic image forming member is provided for transferring color images formed on the member to a transfer medium. The device includes a conductive base layer, an organic photosensitive layer disposed thereon and a dielectric layer on the photosensitive layer. The photosensitive layer is formed of a first charge generation layer disposed on the conductive base and a second change generation layer upon which the dielectric layer is disposed with a charge transportation layer therebetween. The image forming member may also include at least one of a first intermediate layer between the conductive layer and the first charge generation layer and a second intermediate layer between the charge transportation layer and the second charge generation layer. The intermediate layers are insulating layers.

To form an image utilizing the image forming member, the following steps are repeated sequentially for each color. The image forming member (a) is subjected to a first charging, (b) a first exposure at the same time or immediately thereafter, (c) a second charging of opposite polarity and smaller charge, (d) a second exposure, and (e) development with a toner charged with the same polarity as the first charging; and transferring and fixing the toners onto a transfer medium.

An image forming apparatus using the image forming member includes at least: the image forming member; a first charging device for effecting the first charging; a first exposing device for effecting a first exposure in the first charging device during or immediately after the first charging; a second charging device for effecting a second charging of opposite polarity after the first exposing; a second exposing device for effecting a second exposure after the second charging; and a plurarity of toner developers after the second exposing device.

Accordingly, it is an object of the invention to provide an improved electrophotographic image forming member.

Another object of the invention is to provide an improved electrophotographic image transferring apparatus utilizing the improved image forming member.

A further object of the invention is to provide an improved method of forming color images using the improved image transfer member.

Still another object of the invention is to provide an improved image forming member and method and an apparatus utilizing the member in which multiple color images are built up on the surface of the image transfer member for transfer to a transfer medium.

Still other objects and advantages of the invention will in part be obvious and will in part be apparent from the specifications and drawings.

The invention accordingly comprises the several steps and the relation of one or more of such steps with respect to each of the others and the image forming member and the apparatus incorporating the member, embodying features of construction, combinations of elements and arrangements of parts which are adapted to effect such steps, which are exemplified in the following detailed disclosure and the scope of the invention will be indicated in the claims.

BRIEF DESCRIPTION OF THE DRAWINGS

For a fuller understanding of the invention, references had to the following description taken in connection with the accompanying drawings, in which.

DESCRIPTION OF THE PREFERRED EMBODIMENTS

Figure 1:
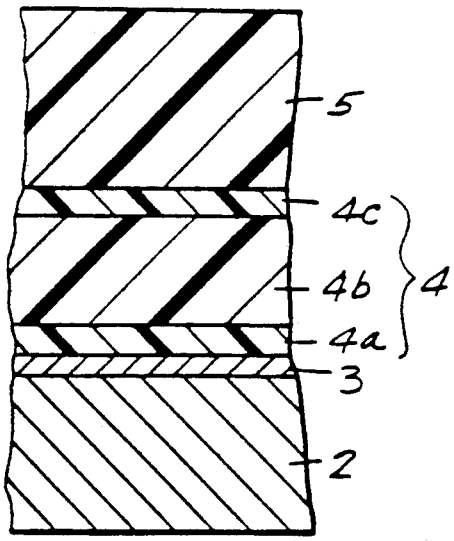
FIG. 1 is a sectional view of the surface of an electrophotographic image forming member constructed in accordance with the invention.

To form images in accordance with the invention, toner images are built up on an image forming member and the toner is then transferred to a suitable transfer medium. The image forming member is formed of a conductive base having an organic photosensitive layer disposed thereon and a dielectric layer formed on the organic photosensitive layer. The organic photosensitive layer includes a first charge generation layer disposed on the conductive base, a charge transportation layer disposed on the first charge generation layer and a second charge generation layer disposed on the charge transportation layer. In addition, the image forming member can include at least one of a first intermediate layer and a second intermediate layer. The intermediate layers are insulating layers which help control the movement of charge. If included, the first intermediate layer is formed between the first charge generation layer and the conductive base. If the second intermediate layer is included, it is formed between the charge transportation layer and the second charge generation layer. Together, these layers form the image forming member of the invention.

The image forming method in accordance with the invention utilizes the image forming medium to form images. The image forming method includes the steps of: a) charging the surface of the image forming member; b) exposing the image forming member either at the same time or immediately after the first charging; c) charging the image forming member a second time, the second charging having opposite polarity to the first charging and being smaller in magnitude; d) exposing the image forming member a second time, the second exposure corresponding to an image; e) adhering toner charged with the same polarity as the first charging to portions of the image forming member which did not receive a second exposure and developing this toner; and f) transferring and fixing the toner to a suitable transfer medium. If multi-color images are desired, steps a through d can be repeated to apply several layers of toner to the image forming member before the toner is transferred to a transfer medium.

During the first charging and the first exposure, charges having opposite polarity to charges from the first charging migrate to the interface of the dielectric layer and the organic photosensitive layer. These charges may be generated from the first charge generation layer and the charges generated from the second exposure can be generated from the second charge generation layer. Alternatively, charges generated from the first exposure may come from the second charge generation layer and charges generated from the second exposure may come from the first charge generation layer.

In general, the different devices which form the image transferring apparatus are arranged around the image forming member in the sequential order of their use. The first exposing device can be provided in the same housing as the first charging device. It can be positioned immediately behind the first charging device or, if the image forming member is transparent to the first exposure, it can be positioned opposite the first charging device with the image forming member therebetween. Likewise, the second exposing device is positioned behind the second charging device. If the image forming member is transparent to the second exposure, the second exposing device can be positioned on the side of the image forming member opposite the side of the second charging device. Otherwise, it is positioned on the same side as the second charging device. One or more toner developing machines are positioned after the second exposing device. Together, these devices form the image transferring apparatus of the invention.

The image forming member is constructed with two charge generation layers. If the charge transportation layer is formed of a material for transferring positive carriers, positive carriers can be transferred in both directions within the organic photosensitive layer by selecting the charge generation layer for which carriers are to be generated. Similarly, when the charge transportation layer includes material for transferring negative carriers, negative carriers can be transported in both directions by selecting in which charge generation layer carriers are to be generated.

As noted above, the first exposure can generate charges from the first charge generation layer or the second charge generation layer and likewise the second exposure can generate charges from the second charge generation layer or the first charge generation layer. This affects the relative positioning of the exposure devices. For example, if the charge transportation layer is a hole transportation type, the first charging is positive and the first exposure sensitizes the second charge generation layer and thereafter the second exposure sensitizes the first charge generation layer, this will determine on which sides of the image forming member to position the exposing devices. If the dielectric layer is transparent to the first exposure, the first exposure can be from the same side as the first charging device If the conductive base and the first charge generation layer are transparent to the first exposure, the first exposure can also come from the side opposite the first charging device. Similarly, if the conductive base is transparent to the second exposure, the second exposure can come from the side opposite the first charging device. If the dielectric layer and the second charge generation layer are transparent to the second exposure, the second exposure can come from the same side as the first charging device. These factors also apply when the first charging is negative and the charge transportation layer is an electron transportation type.

If the image forming member includes one or two intermediate layers, the intermediate layers act to block or trap charges. When a first intermediate layer is included between the first charge generation layer and the conductive layer, it will help prevent charges having the same polarity as the first charging from being poured from the conductive layer into the organic photosensitive layer. If a second intermediate layer is included between the charge transportation layer and the second charge generation layer, it helps prevent charges trapped at the interface of the second charge generation layer and the dielectric layer from pouring into the charge transportation layer.

The image forming member acts to selectively control the movement of charges so that charged toner will adhere where desired. After the first charging and first exposure, charges will be present at the surface of the dielectric layer and an equal amount of opposite charges will be present at the interface of the dielectric layer and the second charge generation layer. The second charging will cancel a portion of the charges on the surface of the dielectric layer yet the charges at the interface of the dielectric layer and the second charge generation layer will remain unaffected. Accordingly, the overall charge at the surface of the image forming member will be of the polarity of the charges at the interface. The second exposure will reduce the charges at the interface. Therefore, portions of the image forming member which received the second exposure will be charged differently than portions which did not receive the second exposure. This difference in charge allows toner to adhere to selected regions of the image forming member.

Because the magnitude of the second charging is less than the first charging, a majority of charges having the same polarity as the first charging will always exist at the surface of the image forming member even during repeated cycles of the process, as layers of toner are built up. Likewise, charges of opposite polarity will always be present at the interface. Therefore, because the toner is charged with the same polarity as the first charging, it will always adhere to the surface of the image forming member and successive layers of toner can even be built up on each other.

Electrophotographic image forming members constructed in accordance with the invention are illustrated in sectional view in FIGS. 1-4 with similar elements identically numbered. An electrophotographic image forming member 1 includes a conductive layer 3 formed on a base 2. An organic photosensitive layer 4 is disposed on conductive layer 3 and a dielectric layer 5 is disposed on organic photosensitive layer 4. Organic photosensitive layer 4 acts as a light sensitive charge switch so that the surface potential of member 1 will be different for portions which are exposed corresponding to an image to be formed.

Base 2 can be in the form of a belt or a drum and supports the functional elements of member 1. Base 2 can be formed of an organic material, such as polyester, polysulfone, polyimide and polycarbonate resins. Alternatively, base 2 can be formed of organic oxides and nitrides. Base 2 can be a drum formed of a metal, such as Al and Cu. If this case, base 2 is electrically conductive and serves as conductive layer 3.

Conductive layer 3 is formed of a binder resin and a conductive material dispersed therein. Suitable binders include thermoplastic resins such as polyvinyl alcohol, polyvinyl pyrrolidone, polyvinyl amine, acacia gum, polyglutamic acid, polyvinyl chloride, polycarbonates, polyvinyl butyral, polystyrene, polyacrylate, polyester and cellulose resins and thermosetting resins, such as epoxy, silicone, urethane, melamine and alkyd resins. To make layer 3 conductive, it includes a metal powder, such as conductive carbon black and Al, salts, such as quaternary ammonium salt dissolved therein, metals, such as Al, Ni and Cu and oxides such as ITO and NESA; and sulfides, such as NiS and CoS. Alternatively, layer 3 can be a conductive polymer, such as a polypyrole and polyaniline.

Organic photosensitive layer 4 includes a charge transportation layer (CTL) **4*b* sandwiched between a first charge generation layer (CGL) 4*a* and a second CGL 4*c*. Charge generation layers 4*a* and 4*c* include various substances dispersed or dissolved within the binder resins described above. The additives to the binder resin can include at least one colorant selected from the group including phthalocyanine, quinacridone, polycyclic quinone, benzidine, azo perylene, indigo, squalilium, azulenium, anthraquinone, thioindigo, cyanine, dioxzine, stilbene, pyrylium, napthalocyanine, pyridinoporphyrazine, ZnO and $TiO_2$. The pigments for the colorants for CGL 4*a* and CGL 4*c* can be selected to be sensitive to different wave lengths or they can be a combination of the same pigment. A metallic soap and the like such as polyethylene glycol and hydroxypropyl cellulose may be added to charge generation layers 4*a* and 4*c*** to enhance the dispersability of the colorant.

Charge transfer layer **4*b* is formed of a high molecular weight charge transfer agent, such as polyvinyl carbazole, methylphenysilicone polymer and propylphenylsilicone polymer, or a binder of the type described above including at least one low-molecular-weight compound, such as hydrazone, triphenylmethane, carbazole, oxazole, oxadiazole, benzidine, stilbene, pyrazoline and triallyl amine. A paraffin halide, polyalkylphthalate, silicone oil or the like may be added to enhance the plasticity of charge transfer layer 4*b***.

Dielectric layer 5 is an oxide, a nitride or a combination of the two, dispersed in a binder resin of the type described above. Preferably, the binder resin should have excellent weatherability, abrasion resistance and insulating properties, such as a polycarbonate resin.

Figure 2:
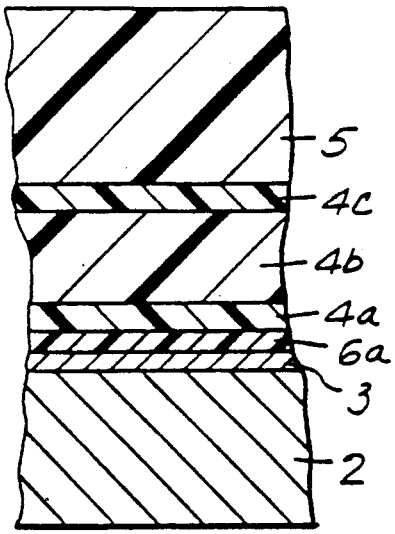
FIG. 2 is a sectional view of the surface of an image forming member including an intermediate layer in accordance with another embodiment of the invention.
Figure 3:
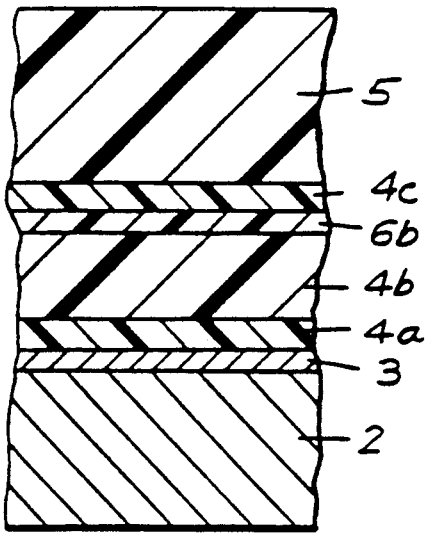
FIG. 3 is a sectional view of the surface of an image forming member including an intermediate layer in accordance with another embodiment of the invention.
Figure 4:
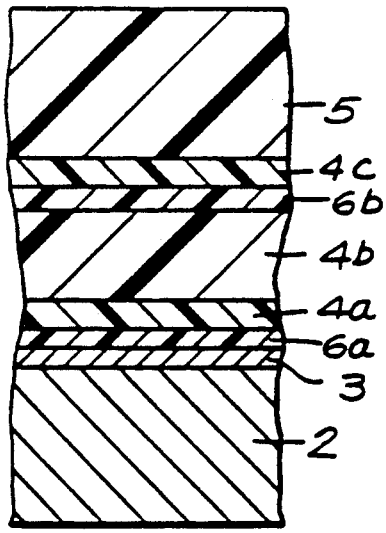
FIG. 4 is a sectional view of the surface of an image forming member including two intermediate layers in accordance with a further embodiment of the invention.

FIGS. 2-4 illustrate embodiments of electrophotographic image forming members which further include a first intermediate layer **6*a* in FIG. 2, a second intermediate layer 6*b* in FIG. 3, or a combination of first intermediate layer 6*a* and second intermediate layer 6*b* as shown in FIG. 4**. The intermediate layers are formed from the above described binder resins. Their function is to limit the movement of charges to improve the performance of the image forming member.

The selection of materials for forming the intermediate layers is dependent on the type of charge transfer layer (CTL) **4*b* that is selected. For example, when CTL 4*b* is a hole transportation type of transfer layer, first intermediate layer 6*a* is preferably a water-soluble resin such as polyvinyl alcohol, polybenzyl alcohol, polyvinyl pyridine, polyarllyl amine, polyvinyl acrylate, hydroxypropyl cellulose and gum arabic. Second intermediate layer 6*b* is preferably a resin in which the ratio of the hole mobility and electron mobility is large and which has an insulating property. Examples include polystyrene, p-type semiconductors such as cupric sulfide and a charge transporting material having a smaller ionization potential than second charge generation layer 4*c***.

Figure 5:
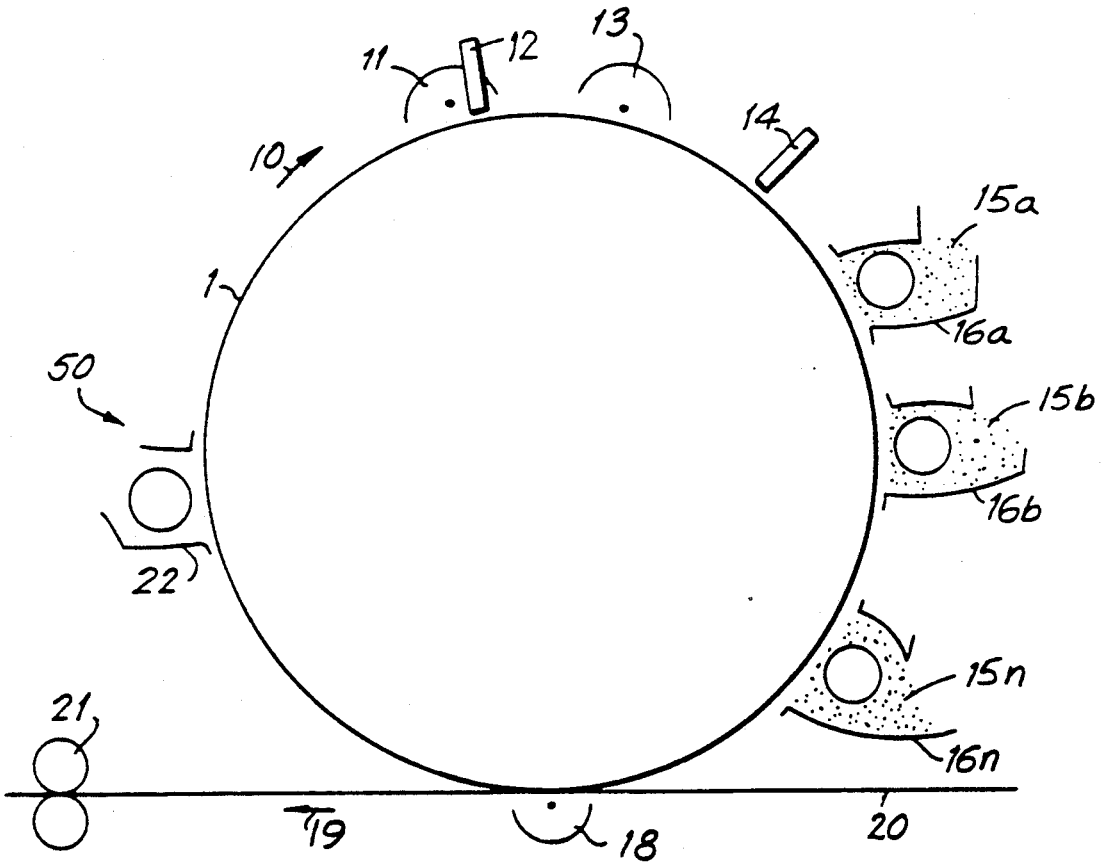
FIG. 5 is a schematic diagram of an electrophotographic image transferring apparatus including an image transfer member of FIGS. 1 to 4 constructed in accordance with the invention.

FIG. 5 is a schematic diagram illustrating an image transfer apparatus 50, for electrophotographic printing including image forming member 1 constructed and arranged in accordance with the invention. Image forming member 1 rotates in the direction indicated by an arrow 10. During operation, image forming member 1 is charged with a first charge $q_1$ by first charging device 11. Either simultaneously or immediately thereafter, device 1 receives a first exposure by a first exposure device 12 which lowers the electrical resistance of organic photosensitive layer 4. The charge and exposure applied to the surface of dielectric layer 5 causes an equal and opposite charge to be formed at the interface of photosensitive layer 4 and dielectric layer 5. Because the resistance of photosensitive layer 4 was reduced during exposure, charges are transferred to the interface.

Figure 6A:
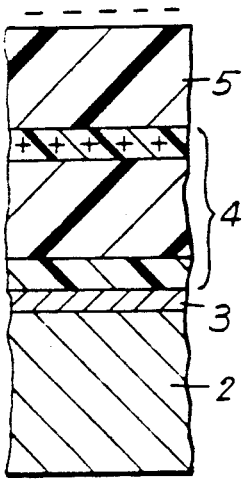
FIG. 6A, 6B and 6C are sectional views of the image forming member of FIG. 1 showing location of charges when utilizing a member according to the invention.

A sectional view of image forming member 1 which received a negative charge from charging device 11 is illustrated in FIG. 6A. The choice of a negative charge rather than positive is purely arbitrary and the invention could have been explained in terms of a positive first charging and a negative second charging. After the first charge $q_1$ and first exposure, the surface of device 1 has a potential of $V_1$ illustrated as region "a" in FIG. 7.

Figure 6B:
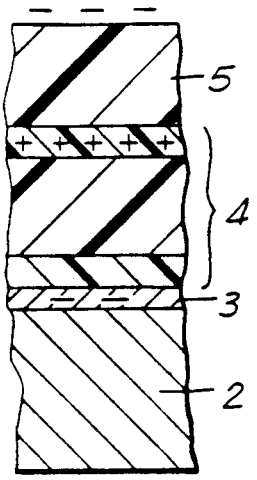

As image forming member 1 continues to rotate in the direction of arrow 10, a second charging device 13 supplies a charge of $q_2$. Second charge $q_2$ has a smaller absolute value than $q_1$ and is opposite in polarity. Accordingly, as shown in FIG. 6B, charge $q_1$ on the surface of member 1 is reduced. However, because there was no exposure to reduce the resistance of photosensitive layer 4, charges having opposite polarity to $q_1$ which were drawn to the interface of dielectric layer 5 and photosensitive layer 4 by the first charging and the first exposure could not escape from photosensitive layer 4. Accordingly, the overall surface potential of image forming member 1 changes in polarity to the polarity of charge $q_2$ and is reduced in value, as shown in region "b" of FIG. 7 and in FIG. 6B.

Image forming member 1 is next subjected to a second exposure by a second exposing device 14. The exposure from second exposing device 14 corresponds to an image of a first color. However, it is the portion of member 1 that is not subjected to a second exposure that will receive toner. The resistance of portions of organic photosensitive layer 4 that receive a second exposure corresponding to the desired image is lowered. The surface potential of image forming member 1 at this portion changes to $V_3$. However, the surface potential of image forming member 1 at the other non-exposed portions remain at $V_2$. Thus, a latent image of a first color is formed.

Figure 6C:
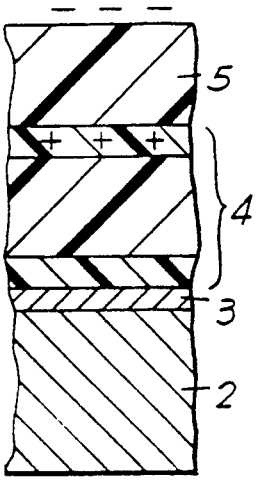
Figure 7:
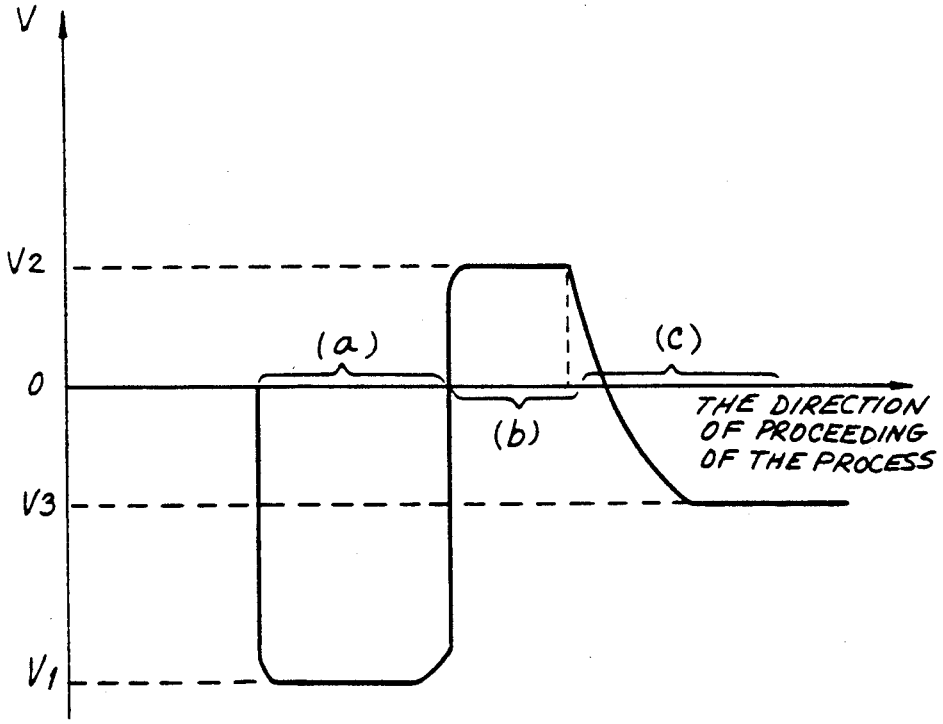
FIG. 7 is a graph showing the change in surface potential of an electrophotographic image forming member in accordance with the invention.

As shown in FIG. 6C and in region "c" in FIG. 7, the charge at the interface of photosensitive layer 4 and dielectric layer 5 is reduced and is now equal to and opposite to the charge at the surface of member 1, having a potential of $V_3$. However, portions of member 1 which were not subjected to a second exposure still have a potential of $V_2$ and the polarity of charge $q_2$. Both $V_2$ and $V_3$ are lower in absolute value than $V_1$ although only $V_3$ is of the same polarity as $V_1$. In FIGS. 6A, 6B and 6C the mark "+" represents positive charges and "−" represents negative charges. In FIG. 7 the abscissa is the rotative direction and the ordinate the surface potential. Regions "a", "b" and "c" of FIG. 7 correspond to FIGS. 6A, 6B and 6C respectively.

The surface area which was subjected to a second exposure corresponding to a first color image has an opposite polarity to the surface which was not exposed the second time. A toner 15*a*, stored in developer 16*a* is charged with the same polarity as charge $q_1$ and $V_3$. Therefore, toner 15*a* will adhere to the portion of the oppositely charged surface of device 1 which was not exposed the second time. This toner will ultimately be transferred to a transfer medium although additional color images can be built up on the surface of device 1 and even on the surface of developed toner.

A number of developers, 16*a*, 16*b*, . . . 16*n*, corresponding to particular colors are arranged around image forming member 1. A bias voltage is applied to the developer which contain the colored toners. The polarity of this bias voltage is the same as the polarity of first charge $q_1$. Accordingly, toner will adhere by electrostatic force to portions of image forming device 1 which did not receive a second exposure.

After the first color image is applied to the surface of image forming member 1, rotation in the direction of arrow 10 continues so that a second color image can be applied. First charging device 11 and first exposure device 12 reestablish a surface voltage of $V_1$. Where toner from the first color already exists, the charges from first charging device 11 will be at the surface of the toner. The toner will adhere to dielectric layer 5 by electrostatic force from the opposite polarity charges below dielectric layer 5.

Second charging device 13 then changes the surface voltage to $V_2$ and second exposing device 14 subjects image forming device 1 to a second exposure. During the second rotation of image forming member 1, the exposure corresponds to a second color image and the portion of the surface of image forming device 1 to receive a second color toner application will retain the oppositely charged potential of $V_2$ and the remainder, for which a second color image is not desired will have a surface potential of $V_3$. However, the portion of the surface of image forming member 1 already having a layer of developed toner will have a potential of $V_3'$. This potential is slightly lower than $V_3$ because the toner increases the effective thickness of dielectric layer 5.

The difference in potential between both $V_3$ and $V_2$ and between $V_3'$ and $V_2$ allows a second color toner 15*b* to adhere to the surface of image forming member 1 because second color toner 15*b* is charged with the same polarity as the first charge $q_1$ by developer 16*b*.

During the second rotation of image forming member 1 for applying second color toner 15*b*, the surface of dielectric layer 5 will have charges with the same polarity as the charge $q_1$ from first charging device 11. Further, the interface of dielectric layer 5 and organic photosensitive layer 4 will always have charges of opposite polarity. Accordingly, the toner of the first color, which will therefore always be positively charged will remain adhered to dielectric layer 5 by electrostatic force during the process for applying the second color image. In fact, if the potential difference $(V_3'-V_2)$ is adequately large, it is possible to develop second color toner 15*b* on top of developed first color toner 15*a*.

The color forming process can be repeated with as many additional colors as is desired. Developer 16*n* containing an n-th color toner 15*n* applies the last desired color image. The toners from the first color through the (n−1)-th color remain adhered to the surface of dielectric layer 5 of image forming member 1 by electrostatic forces as described above. The potential at a portion which has received toners 1 through n−1 is represented as $V_3^{(-1)'}$. If the difference in potential between $V_3^{(n-1)'}$ and $V_2$ is sufficiently large, n-th color toner 15*n* can also be applied.

Various factors must be taken into consideration to insure that $V_3^{(n-1)'}-V_2$ is sufficiently large. The film thickness of each individual toner layer is significant. In order to obtain a potential difference $V_3^{(n-1)'}-V_2$ of more than about 400 V, for example, the following parameters should be satisfied:

$$V_1-V_2 \leqq 113 * t$$

$$V_1-V_2 \geqq 400 * t/t_p$$

$t_p \geqq 3.54\ \mu m$ $t = t_p - t_i - t_t$ wherein $t_p$, $t_i$ and $t_t$ represent the vacuum film thickness of organic photosensitive layer 4, dielectric layer 5 and the developed toner layer, respectively.

In setting forth these parameters, several assumptions are made. First, that all the $q_2$ charges stored at the interface of dielectric layer 5 and organic photosensitive layer 4 from the second charging are eliminated by the second exposure. In other words, it is assumed that $q_2$ is less than the total amount of charge carriers generated by organic photosensitive layer 4. Another assumption is that the quantum efficiency of organic photosensitive layer 4 is about 15% and receives a light projection of about 10 erg/cm$^2$.

The thicknesses of organic photosensitive layer 4 and dielectric layer 5 are constant. The only variable is the thickness of the toner layer $t_t$. If the difference in potential between the portion to which the toner is already adhered ($V_3^{(n-1)'} - V_2$) and to which no toner is applied ($V_3 - V_2$) is too large, the quantity of n-th color toner 15*n* will be different over portion where there is already developed toner and over portions where there is no toner adhered to the surface of image forming member 1. Thus, it is preferable to minimize $t_t$. Various ways of minimizing $t_t$ are available, such as selecting appropriate bias voltages for charging the toners, choosing toners with large dielectric constants or using toners with small particle diameters.

As noted above, toner should be selected with reference to its dielectric constant and particle size. The toner is formed of a colorant such as cyan, magenta, yellow or black dissolved with or dispersed in the above described binder resins. The toner can also include various additives such as a magnetic powder such as $Fe_3O_4$ or $Fe_2O_3$, a charge control agent, a fluidity improver, a cleaning agent and a filler if desired.

After n-th color toner 15*n* is applied, the image built up on the surface of image forming member 1 is transferred to an appropriate transfer medium 20. A transfer device 18 charges transfer medium 20 with a charge having opposite polarity to charge $q_1$ supplied by first charging device 11. Because this charge is opposite the charge of the toner adhered to the surface of image forming member 1, the toner layers are transferred from the surface of image forming member 1 to the surface of transfer medium 20 which moves in the direction of arrow 19. A fixing device 21 fixes the toner image onto transfer medium 20. After the image is completely transferred, residual toner is removed from image forming member 1 by a cleaning unit 22 so that a next electrophotographic color image formation can occur.

For multicolor printing, it is preferable to develop the toner without the developer contacting image forming member 1. If only a single color image is desired, the developer can contact member 1. However, if multicolor images are desired, a non-contacting developing procedure will prevent contamination between the toners.

Several methods are available for contact-developing the toner. For example, one-component or two-component magnetic brush developing, pressure developing, fur brush developing and feed development are acceptable when toner contamination is not a problem.

Various developing procedures for non-contact developing are also available. Such methods include AC jumping development, DC jumping development and powder cloud development. These non-contact developing procedures avoid problems with toner contamination.

Several charging mechanisms are available to be used as first charging device 11, second charging device 13 or transfer device 18. Examples of chargers include coronatron and scoronatron chargers. In order to make the surface potential of image forming member 1 constant, scoronatron chargers are preferable for first charging device 11 and second charging device 13.

Various exposing devices are available. First exposing device 12 and second exposing device 14 can be a halogen lamp, LED and xenon lamp, a laser writing system, a liquid crystal shutter array, LED array and other common electrophotography exposure devices which are available. To fix the toner to the transfer medium, corona transfer and heat roll fixing as well as pressure transfer, adhesion transfer, pressure fixing, flash fixing and the like can be used.

Organic photosensitive layer 4 is formed of two charge generation layers 4*a* and 4*c* with charge transportation layer 4*b* therebetween. The materials for forming charge transportation layer 4*b* can be selected so that it will transfer positive charge carriers in both directions or negative charge carriers in both directions.

During the first exposure and first charging, charges may be generated from first charge generation layer 4*a*. During the second exposure, charges may be generated from second charge generation layer 4*c*. Alternatively, during the first charging and exposure, charges may be generated from second charge generation layer 4*c* and first charge generation layer 4*a* will generate charges during the second exposure.

When charge transportation layer 4*b* is a hole transportation type charge transportation layer and the first charging is a positive charging, the first exposure sensitizes the second generation layer 4*c* and then the second exposure sensitizes first charge generation layer 4*a*.

As shown in FIGS. 2 through 4, image forming member 1 can also include one or two intermediate layers 6*a* and 6*b*. The intermediate layers block or trap charges. When a first intermediate layer is disposed intermediate organic photosensitive layer 4 and conductive layer 3, it will prevent charges which have the same polarity as first charge $q_1$ from being pored from the conductive layer. When a second intermediate layer 6*b* is provided between charge transportation layer 4*b* and second generation layer 4*c*, it will prevent the charge trapped at the interface between second charge generation layer 4*c* and dielectric layer 5 from reentering charge transportation layer 4*b*.

The physical relationship among the various charging and exposing devices and image forming member 1 is flexible and is dependent on the transparency of the layers of image forming member 1. For example, the first charging device 11 can be around image forming member 1. First exposing device 12 can be immediately behind first charging device 11 or opposite first charging device 11 with image forming member 1 therebetween. Second exposing device 14 can be on either the same side of member 1 as second charging device 13, or on the opposite side.

If dielectric layer 5 is transparent to the first exposure, the first exposure can be from the same side as the first charging. If base 2 and conductive layer 3 or a combined conductive base 2 and 3 are transparent to the first exposure, the first exposure can also occur from the opposite side as the first charging. Likewise, if conductive layer 3 and base 2 are transparent to the second exposure, the second exposure can occur from the base side of image forming member 1. When dielectric layer 5 is transparent to the second exposure, the second exposure can also occur from the dielectric layer 5 side. The above also applies when the first charging is negative and the charge transportation layer is an electron transportation type.

Accordingly, by employing an image forming member constructed as described above, it will retain the same amount of charge having opposite polarities at the surface of dielectric layer 5 and at the interface between dielectric layer 5 and second charge generation layer 4c by the first charging and first exposure. Then, a second, opposite charging can cancel a portion of the charges on the surface of dielectric layer 5 without affecting the charges at the interface between dielectric layer 5 and second charge generation layer 4c. The surface will then have an opposite charge. A second exposure, corresponding to an image, will reduce the charges at the interface for exposed portions so that these portions will revert to the original polarity of the first charge. Accordingly, it is possible to alter the surface potential at positions where there is a second exposure and where there is not a second exposure.

Because the absolute value of the second charge is less that the absolute value of the first charge, charges having polarity opposite to the polarity of the first charge will always exist at the interface of dielectric layer 5 and photosensitive layer 4. Accordingly, if the developed toner is charged with the same polarity as the first charging, it will always adhere to the surface of image transfer member 1 by electrostatic forces until it is transferred to transfer medium 20.

The invention will now be explained in greater detail in the following examples. The examples are presented for purposes of illustration only and are not intended to be construed in a limiting sense.

EXAMPLE 1

An image forming member 1-1 in accordance with the invention, similar to member illustrated in FIG. 1 was constructed and evaluated as follows. An Al drum served as both base 2 and conductive layer 3. An x-type metal-free phthalocyanine having a sensitivity in the near infrared region, dispersed in a polyvinyl butyral resin in a weight ratio of about 1:1 was laminated on the Al drum to a thickness of about 0.4 μm to form the first charge generation layer 4a. A layer of tetraphenyl diaminodiphenyl, dissolved together with a polycarbonate resin in a weight ratio of about 1:1 was laminated on first charge generation layer 4a to a thickness of about 20 μm to form charge transfer layer 4b. A γ-type quinacridone having a sensitivity in the visible light range, dispersed in a polyester resin in a weight ratio of about 1:1 was laminated on CTL 4b to a thickness of about 0.4 μm to form second charge generation layer 4c. Finally, a polycarbonate resin was laid on second CGL 4c to a thickness of about 20 μm to form dielectric layer 5. Together, these layers formed image forming device 101.

Three image forming member corresponding to FIGS. 2-4 were also prepared. A second image forming member 1-2 was produced by inserting about a 0.5 μm thick layer of polyvinyl pyrrolidone between the conductive layer 3 and CGL 4a of image forming device 1-1 to form first intermediate layer 6a. An image forming member 1-3 was prepared by disposing about a 0.1 μm thick layer of polystyrene, to form second intermediate layer 6b, between CTL 4b and CGL 4c of image forming device 101. An image forming member 1-4 was prepared by disposing about a 0.5 μm thick layer of polyvinyl pyrrolidone to form first intermediate layer 6a between conductive layer 3 and CGL 4a and disposing about a 0.1 μm thick layer of polystyrene as second intermediate layer 6b between CTL 4b and CGL 4c, of image forming member 1-1.

Image forming member 1-1, 1-2, 1-3 and 1-4 were incorporated into an image transferring apparatus similar to apparatus 50, shown in FIG. 5 and evaluated. Changes in the surface potential of each of the image forming devices were examined. Surface potentiometers (not shown) were placed immediately before second charging device 13, immediately before second exposing device 14 and immediately before first developing machine 16a.

Image forming conditions are as follows. Charge transportation layer 4b was a hole transportation type. A halogen lamp having a wavelength cut to about 500 nm to 600 nm was used as first exposing device 12 to sensitize second CGL 4c during the first exposure. The surface potential, $V_1$, of image forming device 1 after the first exposure, before the second charging set to be 800 V. The surface potential $V_2$ after the second charging was set to be −200 V. A laser writing system was used as a second exposing device and sensitized first CGL 4a. The potential after the laser writing system should have been 300 V. The values recorded on the potentiometers are shown below in Table 1. It is evident that intermediate layers 6a and 6b allow the image forming device to more closely approximate the predicted results.

TABLE 1

| | Before Second Charging (V) | After Second Charging (V) | After Second Exposure (V) | Results |
|---|---|---|---|---|
| Predicted Results | 800 | −200 | 300 | — |
| Image forming member 1-1 | 770 | −160 | 250 | acceptable |
| Image forming member 1-2 | 790 | −170 | 270 | better |
| Image forming member 1-3 | 780 | −180 | 270 | better |
| Image forming member 1-4 | 795 | −185 | 285 | best |

Image forming member 1-1 was used in an apparatus similar to apparatus 50 to form a color image. The following toners were prepared: a magenta toner formed of a styrene-acryl copolymer with 10 wt % of Carmine 6B dispersed therein; a cyan toner formed of a styrene-acryl copolymer with 10 wt % of copper phthalocyanine dispersed therein; a yellow toner formed of a styrene-acryl copolymer with 15 wt % disazo yellow dispersed therein; and a black toner formed of a styrene-acryl copolymer with 8 wt % furnace black dispersed therein. These toners were first, second, third and fourth colors, respectively. The above-described conditions for forming a latent image were adopted. They satisfy the conditions 1 to 3 as long as the developed toner is only one or two layers thick.

DC jumping developers were used as the developers for forming latent images of the first through fourth colors. The average amount of charge of each toner q/m was 5 to 13 μC/g and the average particle diameter of the toner was 10 μm. The developed toner of each color was made into only one or two layers.

After the development of the toner of the fourth color, a bias voltage (not shown) was applied to a corona transfer apparatus 18. It projected a corona having the opposite polarity to first charging device 11 onto transfer medium 20, thereby inducing the transfer of the toner images developed on image forming member 1, in a lump, onto transfer medium 20. The toner image transferred onto transfer medium 20 was then fixed thereon by a heat roll fixing machine 21. When transfer of the toner image was completed, the remaining toner was removed from image forming member 1 by cleaning unit 22 to prepare image forming member 1 for the next process of color image formation.

The color images formed with electrophotographic apparatus 50 had good color reproducibility and were free from photographic fog and scumming. These results applies to the first image reproduced as well as to the 1,000th.

EXAMPLE 2

An additional image forming member 2-1 in accordance with the invention was prepared as follows. A polycarbonate drum was used as base 2 and a deposited ITO film was used as conductive layer 3. A B-type copper phthalocyanine deposited film was laid on the ITO deposited film to a thickness of about 0.2 μm to form CGL 4*a*. A diphenyl hydrazone compound, dissolved together with a polycarbonate resin in a weight ratio of about 1:0.8 was laid on the charge generation layer 4*a* to a thickness of about 18 μm to form charge transportation layer 4*b*. A β-type copper phthalocyanine, dispersed in a polybutyl methacrylate resin in a weight ratio of about 1:1 was laid on transportation layer 4*b* to a thickness of 0.4 μm to form second charge generation layer 4*c*. A silicone resin was laid on generation layer 4*c* to a thickness of about 20 μm to form dielectric layer 5 to complete image forming member 2-1.

By adding intermediate layers to device 2-1, additional image forming members were constructed. An image forming member 2-2 was prepared by inserting first intermediate layer 6*a* of casein sodium having a thickness of about 0.5 μm between conductive layer 3 of image forming member 2-1. An image forming member 2-3 was formed by disposing cupric sulfide dispersed in polyacrylonitrile in a weight ratio of about 1:4 to a thickness of about 0.3 μm as second intermediate layer 6*b*, between CTL 4*b* and CGL 4*c*. Image forming member 2-4 includes casein sodium having a thickness of about 0.5 μm as first intermediate layer 6*a* between conductive layer 3 and CGL 4*a* and cupric sulfide dispersed in polyacrylonitrile in a weight ratio of 1:4 to a thickness of 0.3 μm as second intermediate layer 6*b* between CTL 4*b* and the CGL 4*c*.

Figure 8:
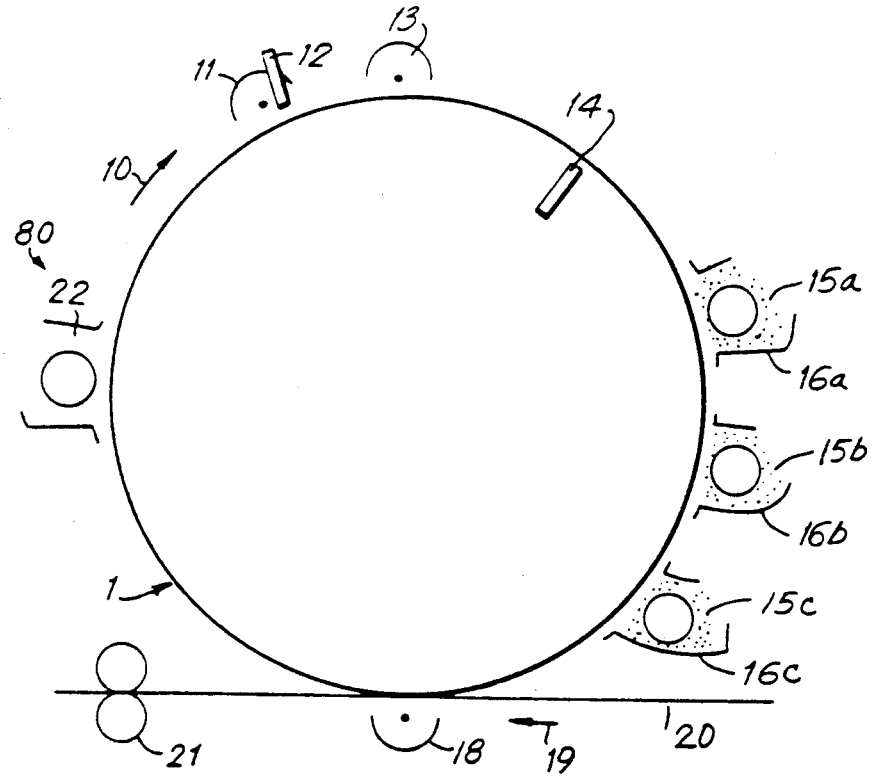
FIG. 8 is a schematic diagram of an electrophotographic image transferring apparatus constructed in accordance with the invention.

These four image forming members were utilized in an image transfer apparatus similar to an apparatus 80 shown in FIG. 8 for evaluation. Changes in the surface potential of each of the image forming members were examined as in Example 1. The same reference numerals are provided for identical elements as in Example 1. A fluorescent lamp was used in first charging device 11 as first exposing device 12 to sensitize CGL 4*c* by exposure and an LED array was provided in the image forming device as second exposing device 14 to sensitize CGL 4*a*. The results are shown in Table 2. Once again, the apparatus performed as expected and the intermediate layer aided in controlling charge movement to allow the device to work as predicted.

TABLE 2

| | Before Second Charging (V) | After Second Charging (V) | After Second Exposure (V) | Results |
|---|---|---|---|---|
| Predicted Results | 800 | −200 | 300 | — |
| Image forming member 2-1 | 770 | −150 | 250 | acceptable |
| Image forming member 2-2 | 790 | −170 | 270 | better |
| Image forming member 2-3 | 780 | −185 | 270 | better |
| Image forming member 2-4 | 795 | −190 | 290 | best |

Image forming device 2-3 was incorporated into the apparatus similar to apparatus 80 to form a color image. The above-described conditions for forming a latent image were adopted. They satisfy the conditions 1 to 3 as long as each of the developed toner colors is only one or two layers thick. A color image was formed in the same way as in Example 1 except for the conditions for forming a latent image.

The color images formed had good color reproducibility and were free from photographic fog and scumming. These results applied to the first image reproduced as well as to the 1,000th.

EXAMPLE 3

An image forming member 3-1 was constructed in accordance with the invention as follows. A transparent polymethyl methacrylate drum was used as base 2 and an ITO sputtered film was conductive layer 3. Rhodamine B dispersed in a polycarbonate resin in a weight ratio of about 1:1 was laid on conductive layer 3 to a thickness of about 0.3 μm to form CGL 4*a*. Polyvinyl carbazole was laid on CGL 4*a* to a thickness of about 18 μm as CTL 4*b*. β-type copper phthalocyanine, dispersed in a polycarbonate resin and a polybutyral resin in a weight ratio of about 2:1:1 was laid on CTL 4b to a thickness of about 0.3 μm to form CGL 4c. Finally, silicone resin was laid on CGL 4c to a thickness of 20 μm to form dielectric layer 5, thereby producing image forming device 3-1.

Additional members were constructed by including intermediate layers into member 3-1. An image forming member 3-2 was produced by inserting about a 0.1 μm thick layer of nylon to form first intermediate layer 6a between conductive layer 3 and first CGL 4a of image forming member 3-1. An image forming member 3-3 was produced by inserting about a 2 μm thick layer of tetraphenyl diaminostilbene dispersed in polycarbonate in a weight ratio of about 1:1 as second intermediate layer 6b, between CTL 4b and second CGL 4c. An image forming member 3-4 was prepared by inserting about a 0.1 μm thick layer of nylon, to form first intermediate layer 6a between conductive layer 3 and the first CGL 4a and inserting a 2 μm thick layer of tetraphenyl diaminostilbene dispersed in polycarbonate in a weight ratio of about 1:1 to form second intermediate layer 6b between CTL 4b and CGL 4c of image forming member 3-1.

These image forming members were incorporated into an apparatus similar to apparatus 80 of FIG. 8 for evaluation. Changes in the surface potential of each image forming device were examined as in Example 1 except that $V_1$ was to be 600 V and $V_2$ was to be −170 V. The results are shown in Table 3.

TABLE 3

| | Before Second Charging (V) | After Second Charging (V) | After Second Exposure (V) | Results |
|---|---|---|---|---|
| Predicted Results | 600 | −170 | 320 | — |
| Image forming member 3-1 | 540 | −130 | 270 | acceptable |
| Image forming member 3-2 | 570 | −150 | 285 | better |
| Image forming member 3-3 | 580 | −155 | 290 | better |
| Image forming member 3-4 | 595 | −160 | 310 | best |

Image forming member 3-4 was incorporated into an apparatus similar to apparatus 80 to form a color image. The above-described conditions for forming a latent image were adopted. They satisfy the conditions 1 to 3 as long as each of the developed toner colors is only one or two layers thick. A color image was formed in the same way as in Example 1 except for the conditions for forming a latent image.

The color images formed with the electrophotographic apparatus similar to apparatus 80 had good color reproducibility and were free from photographic fog and scumming. These results apply to the first images reproduced as well as to the 1,000th.

EXAMPLE 4

Additional image forming members were formed by including alternative intermediate layers within member 2-1 as follows. An image forming member 4-2 was prepared by forming a polyvinyl butyral resin having a thickness of about 0.5 μm as first intermediate layer 6a between conductive layer 3 and CGL 4a of the image forming member 2-1 of Example 2. An image forming member 4-3 was prepared by inserting a polyvinyl butyral resin having a thickness of about 0.5 μm as the second intermediate layer between CTL 4b and second CGL 4c. An image forming member 4-4 was prepared by inserting a polyvinyl butyral resin having a thickness of about 0.5 μm as first intermediate layer 6a between conductive layer 3 and CGL 4a and inserting a polyvinyl butyral resin having a thickness of 0.5 μm as second intermediate layer 6b between CTL 4b and the CGL 4c of member 2-1.

Figure 9:
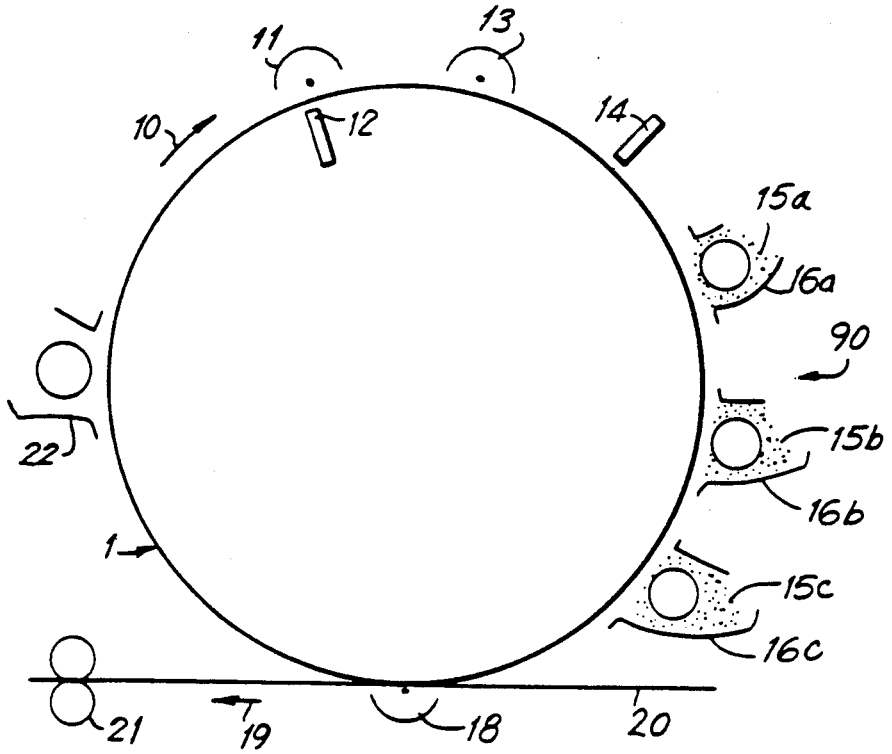
FIG. 9 is a schematic diagram of an electrophotographic image transferring apparatus constructed in accordance with another embodiment of the invention.

These image forming members were incorporated into an apparatus similar to an apparatus 90 shown in FIG. 9 for testing. Changes in the surface potential of each of the image forming members were examined. The same reference numerals are provided for the elements which are the same as shown in FIG. 5. Latent images were made in the same way as in Example 1 except that $V_1$ was to be −800 V and $V_2$ was to be 200 V and that CGL 4a was sensitized by projecting light from the base side of the image forming device by first exposing device 12 and CGL 4c was sensitized by second exposing Device 14. The results are shown in Table 4.

TABLE 4

| | Before Second Charging (V) | After Second Charging (V) | After Second Exposure (V) | Results |
|---|---|---|---|---|
| Predicted Results | −800 | 200 | −300 | — |
| Image forming member 2-1 | −750 | 150 | −270 | acceptable |
| Image forming member 4-2 | −780 | 170 | −285 | better |
| Image forming member 4-3 | −760 | 180 | −290 | better |
| Image forming member 4-4 | −790 | 190 | −290 | best |

Image forming member 4-4 was included into an apparatus similar to apparatus 90 to form a color image. The above-described conditions for forming a latent image were adopted. They satisfy conditions 1 to 3 as long as each of the developed toner colors is only one or two layers thick. The toners used were a yellow toner composed of a styrene-butadiene copolymer with 15 wt % of Hansa Yellow 5G dispersed therein and 0.5 wt % of hydrophobic silica added thereto; a magenta toner composed of a styrene-butadiene copolymer with 12 wt % of quinacridone dispersed therein and 0.5 wt % of hydrophobic silica added thereto; a cyan toner composed of a styrene-butadiene copolymer with 10 wt % of indanthrene blue dispersed therein and 0.5% of hydrophobic silica added thereto; and a black toner composed of a styrene-butadiene copolymer with 10 wt % of furnace black dispersed therein and 0.5 wt % of hydrophobic silica added thereto. These were the toners of the first, second, third and fourth colors, respectively. The average amount of charge of each toner q/m was about −5 to −12 μC/g and the average particle diameter of the toner was 7 to 9 μm.

After development of the toner of the fourth color, a bias voltage was applied by corona transfer machine 18, to project a corona having an opposite polarity to first charging device 11, onto transfer medium 20, thereby transferring the developed toner images in a lump. The toner image transferred on recording member 20 was then fixed thereon by heat roll fixing machine 21. When transfer of the toner image was completed, the remaining toner was removed by cleaning unit 22 to prepare image forming member 1 for the next process of color image formation.

The color images formed with the electrophotographic apparatus similar to apparatus 90 had good color reproducibility and were free from photographic fog and scumming. These results applies to the first images reproduced as well as to the 1,000th.

EXAMPLE 5

A color image was formed as in Example 4, except that the average particle diameters of the toners of the first, second, third and fourth colors were restricted to 12, 10, 9 and 8 μm, respectively. Color images having improved transfer efficiency and good color reproducibility were obtained.

EXAMPLE 6

A color image was formed as in Example 4 except that the average particle diameter of the toner was 10 μm, the average amount of charge q/m of the toner of the first color was −5 μC/g and the average amount of charge q/m of the other toners was −10 μC/g, a color image having improved color reproducibility was obtained.

As described above, an image forming member in accordance with the invention includes an organic photosensitive layer on a conductive base and a dielectric layer thereon. The organic photosensitive layer is formed of at least a first charge generation layer and a second charge generation layer with a charge transportation layer therebetween. It is possible to transport change carriers having a positive (or negative) polarity not only in one direction, but also in both directions in the organic photosensitive layer. Thereby, a portion of the charges having a negative (or positive) polarity which exist at the interface of the organic photosensitive layer and the dielectric layer can be transported by the charge carriers having a positive (or negative) polarity which are generated by the second exposure.

In addition, since the image forming member according to the invention can include at least one of a first intermediate layer provided between the organic photosensitive layer and the conductive layer and a second intermediate layer provided between the charge transportation layer and the second charge generation layer, it is possible to reduce the attenuation of the surface potential during the process, thereby enlarging the ranges of process conditions.

The image forming method utilizes the image forming member by repeating the steps of: a first charging, a first exposure at the same time with or immediately after the first charging, a second charging having opposite polarity to the first charging and having a smaller amount of charge in the absolute value than the first charging, a second exposure and development with a toner charged with the same polarity as the first charging. Afterwards, the toner layers are transferred and fixed to a transfer medium.

Charges having the opposite polarity to the first charging constantly exist at the interface between the organic photosensitive layer and the dielectric layer of the image forming member during the process. There is never an excess of charges having an opposite polarity to the first charging exist on the surface of the dielectric layer of the image forming member. This enables the developed toners to be retained on the surface of the image forming device and to be transferred onto the transfer medium in a lump. Thus, the invention produces a color image having a good image quality without producing nonuniformity in image and a shear in colors while using simple structures.

The image transferring apparatus using the image forming member according to the present invention includes at least: the above-described image forming member; a first charging device for effecting a first charging provided around the image forming member; a first exposing device for a first exposure which is provided in the first charging device, positioned immediately behind the first charging device, or opposite to the first charging device with the image forming member therebetween; a second charging device for effecting a second charging with opposite polarity than the first charging, positioned behind the first exposing device; a second exposing device positioned behind the second charging device and on the same side as or the opposite side as the first charging device; and a plurality of toner developing machines positioned behind the second exposing device. The image transferring apparatus of the invention has a simple structure and is small-sized and portable. In addition, it is capable of producing a color image having good image quality without producing nonuniformity in image and a shear in colors and at a low cost.

It will thus be seen that the objects set forth above, among those made apparent from the preceding description, are efficiently attained and, since certain changes may be made in carrying out the above method and in the constructions set forth without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

Particularly it is to be understood that in said claims, ingredients or compounds recited in the singular are intended to include compatible mixtures of such ingredients wherever the sense permits.

What is claimed is:

1. A method of forming an electrophotographic image, comprising:

charging an electrophotographic image forming member with a first charge $q_1$ and administering a first exposure, the first exposure during or immediately after the first charging, the image forming member including a conductive base layer, an organic photosensitive layer disposed on the conductive layer, the photosensitive layer having a first charge generation layer adjacent to the conductive layer, a charge transportation layer thereon and a second charge generation layer disposed on the charge transportation layer, and a dielectric layer on the photosensitive layer;

charging the image forming member with a second charge $q_2$, such that $q_2$ is smaller in magnitude and of opposite polarity than $q_1$ so that there are charges with the same polarity as $q_1$ at the surface of the dielectric layer and a greater quantity of charges having the polarity of $q_2$ at the interface of the dielectric layer and the photosensitive layer and the overall charge of the device is of the same polarity as $q_2$;

exposing the image forming member with a second exposure corresponding to an image so that the charge of the image forming member at the portions exposed with the second exposure is of the polarity of $q_1$, to form a latent image;

development of the latent image on the image forming member with toner having a charge of the same polarity as $q_1$, the first charging; and transferring the toners from the image forming member onto a transfer medium and fixing the toners onto the transfer medium.

2. The method of forming an electrophotographic image of claim 1, wherein the first charge generation layer and the second charge generation layer each include at lest one binder resin and at lest one colorant admixed therein.

3. The method of forming an electrophotographic image of claim 2, wherein the colorant is selected from the group consisting of $\beta$-type copper phthalocyanine, x-type metal, free phthalocyanine, $\gamma$-type quinacridone and rhodamine B and combinations thereof.

4. The method of forming an electrophotographic image of claim 1, wherein the charge transportation layer includes at least one charge moving agent selected from the group consisting of high molecular weight polyvinylcarbazole, poly(methylphenyl)silicone, poly(-proprylphenyl)silicone and a binder resin admixed with at least one compound selected from the group consisting of hydrazones, triphenylmethane, carbazoles, oxazoles, oxadiazoles, benzidine, stilbene, pyrazoline, triallyl amine and mixtures thereof.

5. The method of forming an electrophotographic image of claim 1, wherein the charge transportation layer includes a binder and at least one charge moving agent selected from the group consisting of tetraphenyl diaminodiphenyl and diphenyl hydrazone admixed therein.

6. The method of forming an electrophotographic image of claim 1, further including at least one of a first intermediate layer positioned intermediate the conductive layer and the first charge generation layer and a second intermediate layer positioned intermediate the charge transportation layer and the second charge generation layer, wherein the at least one intermediate layer limits the movement of charges within the image forming member.

7. The method of forming an electrophotographic image of claim 6, wherein the at least one intermediate layer is formed of a binder resin selected from the group consisting of thermoplastic resins and thermosetting resins.

8. The method of forming an electrophotographic image of claim 6, wherein the intermediate layer is selected from the group consisting of polyvinyl pyrrolidone, polystyrene, casein sodium, polyacrylonitrile containing cupric sulfide, polyvinyl butyral resin containing tetraphenyl diaminostilbene, nylon containing tetraphenyl diaminostilbene and polycarbonate resin containing tetraphenyl diaminostilbene and combinations thereof.

9. The method of forming an electrophotographic image of claim 1, wherein the conductive base layer is selected from the group consisting of a conductive metal, a resin having a conductive metal powder dispersed therein, a conductive salt, a conductive metal oxide, a conductive metal sulfide and a conductive polymer.

10. The method of forming an electrophotographic image of claim 1, wherein multiple layers of toner can be built up on each other.

11. The method of forming an electrophotographic image of claim 1, wherein at least one of the charging steps is performed by at least one of a scoronatron charger and a coronatron charger.

12. The method of forming an electrophotographic image of claim 1, wherein at least one of the exposure steps is performed by at least one of a halogen lamp, an LED, a xenon lamp, a laser writing system and a liquid crystal shutter array.

13. The method of forming an electrophotographic image of claim 1, wherein the steps of charging, exposing and developing are repeated for selected toner colors.

14. The method of forming an electrophotographic image of claim 5, wherein the charge transportation layer includes an agent to enhance the plasticity of the charge transportation layer.

15. The method of forming an electrophotographic image of claim 14, wherein the agent is selected from the group consisting from paraffin halides, polyalkylphthalate, silicone oil and combinations thereof.

* * * * *